US007140217B1

(12) United States Patent
Marks et al.

(10) Patent No.: US 7,140,217 B1
(45) Date of Patent: Nov. 28, 2006

(54) HYDROFORM DIE TUBE HOLDING ASSEMBLY AND METHOD OF MAKING SAME

(75) Inventors: Kevin R. Marks, Durand, MI (US); Michael L. Raby, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/190,532

(22) Filed: Jul. 27, 2005

(51) Int. Cl.
*B21D 26/02* (2006.01)
*B21D 9/15* (2006.01)
*B23P 17/02* (2006.01)

(52) U.S. Cl. ..... 72/62; 72/61; 29/421.1

(58) Field of Classification Search ..... 72/56, 72/57, 58, 59, 61, 62
See application file for complete search history.

(56) References Cited

U.S. PATENT DOCUMENTS

| | | | | |
|---|---|---|---|---|
| 5,233,854 | A * | 8/1993 | Bowman et al. | 72/58 |
| 5,233,856 | A * | 8/1993 | Shimanovski et al. | 72/62 |
| 5,321,964 | A * | 6/1994 | Shimanovski et al. | 72/62 |
| 6,279,364 | B1 * | 8/2001 | Morphy et al. | 72/58 |
| 6,637,246 | B1 * | 10/2003 | Shimanovski et al. | 72/62 |
| 6,732,560 | B1 * | 5/2004 | Winterhalter et al. | 72/62 |

* cited by examiner

*Primary Examiner*—David Jones
(74) *Attorney, Agent, or Firm*—Laura C. Hargitt

(57) ABSTRACT

A hydroform die tube holding assembly and method of using same includes at least one seal unit for sealing an end of a tube. The hydroformed die tube holding assembly also includes a seal unit elevator for attachment to a lower die half to operatively support the at least one seal unit. The hydroformed die tube holding assembly further includes at least one upper gas spring for attachment to an upper die half to engage, the seal unit elevator to drive the seal unit elevator downward prior to the upper die half engaging the tube.

19 Claims, 4 Drawing Sheets

FIG 4
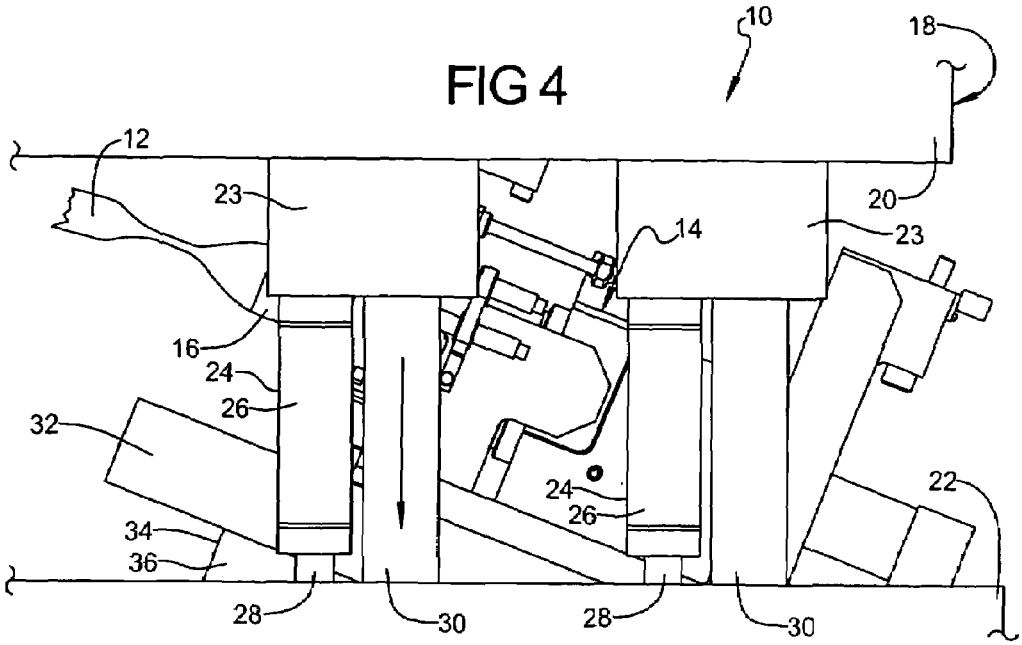
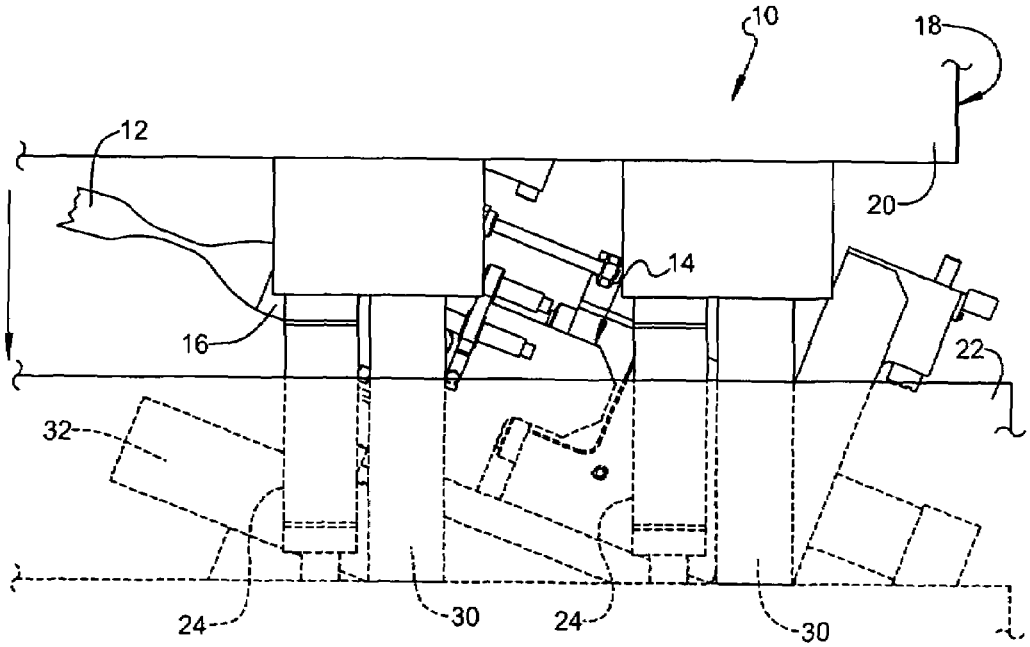
FIG 5

HYDROFORM DIE TUBE HOLDING ASSEMBLY AND METHOD OF MAKING SAME

TECHNICAL FIELD

The present invention relates generally to hydroforming and, more particularly, to a hydroform die tube holding assembly and method of making same for automotive structures.

BACKGROUND OF THE INVENTION

It is known to hydroform tubular components or members. Hydroformed tubular members are becoming increasingly popular in automotive body structural applications. During vehicle body manufacturing, many of the hydroformed tubular members are used in vehicle body and chassis applications. However, vehicle strength, stiffness, and/or impactworthiness often necessitate the need for local areas of structural reinforcement to meet their design goals.

Tube sealing is a major factor in the tube hydroform process. Seal units may be mounted on nitrogen powered elevators. The tube is filled (fill pressure) and the round tube is stuffed into the die cavity to bottom. Press tonnage is applied and form pressure is initiated forming the tube to the cavity. This process eliminates the need for a pre-form die operation.

When the seal units do not directly oppose one another, the pneumatic clamp devices do not provide capability to hold the bent tube into proper position. When finish part geometry changes round tube near seals, the tubes tend to move within the sealing process (creating sealing inefficiencies).

As a result, it is desirable to provide a new hydroform die tube holding device. It is also desirable to provide a hydroformed tubular member that is locally and internally reinforced prior to the hydroforming process. It is further desirable to provide a method of locally and internally reinforcing a hydroformed tubular member. Therefore, there is a need in the art to provide a new hydroform die tube holding assembly and method of making same that meets these desires.

SUMMARY OF THE INVENTION

Accordingly, the present invention is a hydroform die tube holding assembly including at least one seal unit for sealing an end of a tube. The hydroformed die tube holding assembly also includes a seal unit elevator for attachment to a lower die half to operatively support the at least one seal unit. The hydroformed die tube holding assembly further includes at least one upper gas spring for attachment to an upper die half to engage the seal unit elevator to drive the seal unit elevator downward prior to the upper die half engaging the tube.

Also, the present invention is a method of hydroforming a tube using a hydroform die tube holding assembly. The method includes the steps of providing a seal unit for sealing an end of a tube and supporting the seal unit with a seal unit elevator on a lower die half. The method also includes the steps of providing at least one upper gas spring for attachment to an upper die half and engaging the seal unit elevator with the at least one upper gas spring. The method further includes the steps of driving the seal unit elevator downward prior to the upper die half engaging the tube, closing the upper die half and lower die half together, and hydroforming the tube to form a hydroformed tubular member.

One advantage of the present invention is that a hydroform die tube holding assembly is provided for hydroforming a tubular member. Another advantage of the present invention is that a method of making a hydroform die tube holding assembly is provided to form a hydroformed tubular member by holding the tubular member in position before the die closes to the bottom. Yet another advantage of the present invention is that the assembly and method adds the ability to manufacture products with additional form (sections) at the tube ends, near the seal units. Still another advantage of the present invention is that the assembly and method adds the ability to hold the round tube into position and improve sealing condition by not allowing the tube to move over the o-ring seal. A further advantage of the present invention is that the assembly and method reduces downtime and die maintenance. Yet a further advantage of the present invention is that the assembly and method adds design flexibility to locally and internally reinforce hydroformed tubular members for crashworthiness, strength, and/or stiffness improvements.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 4 is a view similar to FIG. 1 illustrating a second step of operation of the hydroform die tube holding assembly of FIGS. 1 and 2.

FIG. 5 is a view similar to FIG. 1 illustrating a third step of operation of the hydroform die tube holding assembly of FIGS. 1 and 2.

DESCRIPTION OF THE PREFERRED EMBODIMENT

Figure 1:
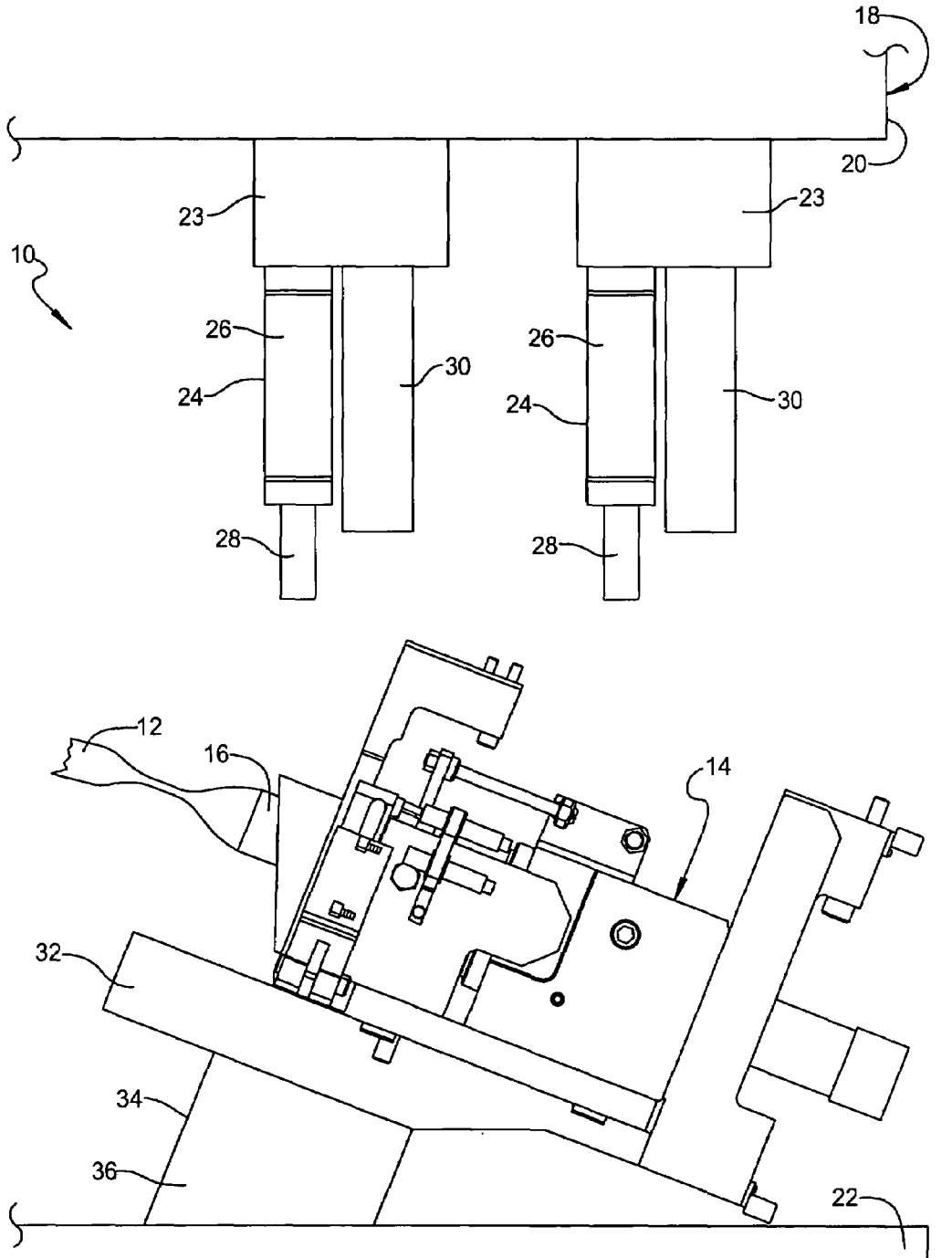
FIG. 1 is a fragmentary elevational view of a hydroform die tube holding assembly, according to the present invention.
Figure 2:
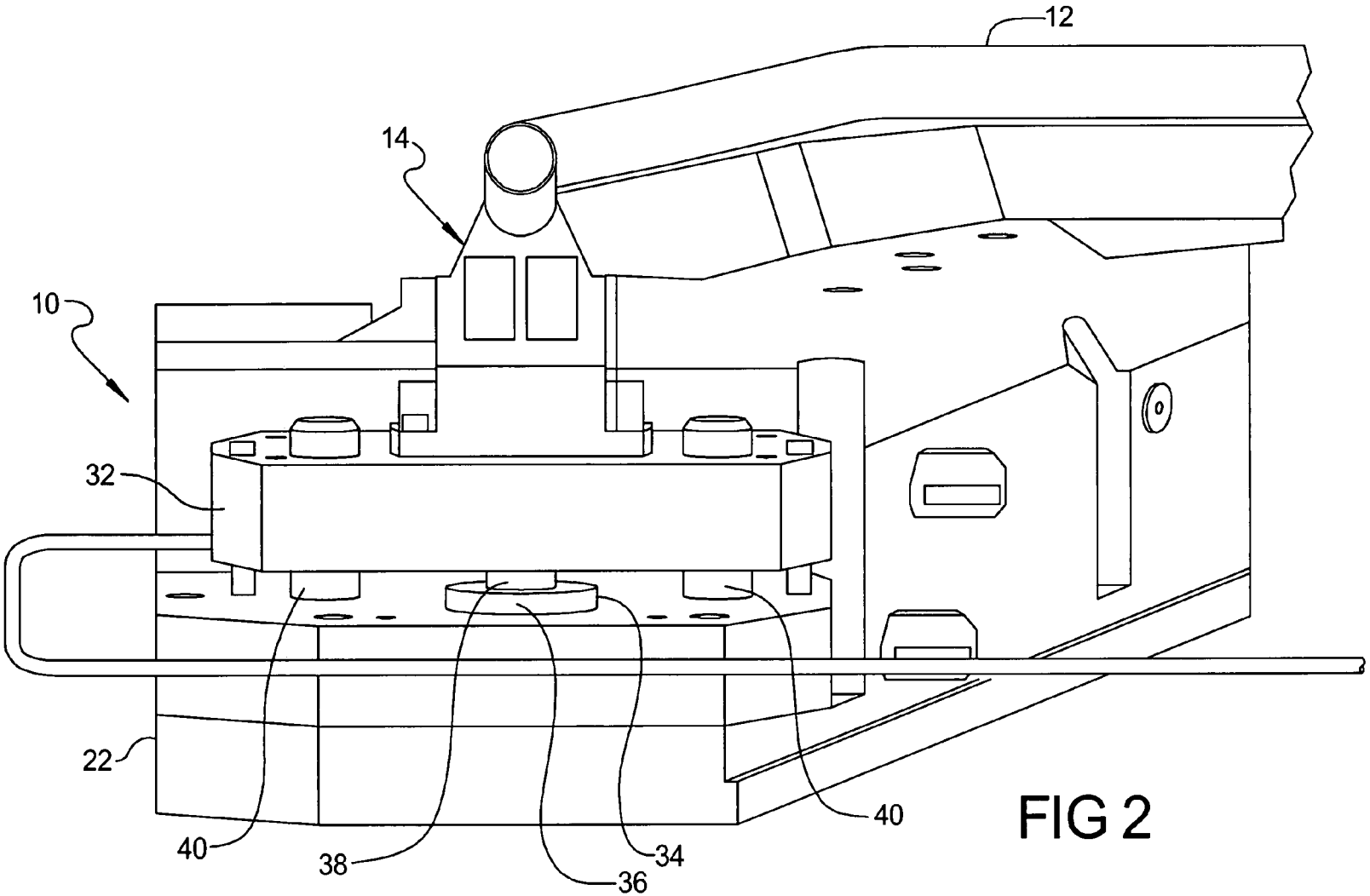
FIG. 2 is an elevational view of the hydroform die tube holding assembly of FIG. 1.

Referring to the drawings and in particular FIGS. 1 and 2, one embodiment of a hydroform die tube holding assembly 10, according to the present invention, is shown for hydroforming a tube 12 used for assembly in automotive structures (not shown) of a vehicle (not shown). The hydroform die tube holding assembly 10 includes at least one, preferably a pair of seal units, generally indicated at 14, to seal the ends of the tube 12. Each seal unit 14 includes an axial protrusion 16. One end of the tube 12 is placed over the protrusion 16 of the seal unit 14. It should be appreciated that the other end of the tube 12 would also be placed over the protrusion 16 of the other seal unit 14. It should also be appreciated that the seal units 14 do not oppose one another. It should further be appreciated that only the one seal unit 14 for the hydroform die tube holding assembly 10 will be subsequently described. It should still further be appreciated that the seal unit 14 is conventional and known in the art.

Each seal unit 14 is placed in a die set, generally indicated at 18, comprised of an upper die half 20 and a lower die half 22. The upper die half 20 includes a cavity portion (not shown) and the lower die half 22 includes a cavity portion (not shown) for receiving the tube 12. It should be appreciated that the upper die half 20 and lower die half 22 are progressively closed so that the tube 12 is progressively deformed into the cavity portion of the die set 18.

The hydroform die tube holding assembly 10 includes at least one, preferably a plurality of mounting blocks 23 connected to the upper die half 20 by a suitable mechanism such as fasteners (not shown). The hydroform die tube holding assembly 10 includes at least one, preferably a plurality of gas springs 24 extending downwardly from the mounting blocks 23. Preferably, four gas springs 24 are used (only two shown). The gas springs 24 are of a nitrogen gas type. Each of the gas springs 24 includes a cylinder 26, a piston (not shown) disposed in the cylinder 26, and a piston rod 28 connected to the piston and extending axially from one end of the cylinder 26. One of the cylinders 26 is connected to one of the mounting blocks 23 by a suitable mechanism such as fasteners (not shown). It should be appreciated that the cylinders 26 are connected to a source of gas (not shown) via a suitable mechanism such as hoses (not shown).

The hydroform die tube holding assembly 10 includes at least one, preferably a plurality of locators 30 extending downwardly from the mounting blocks 23. Preferably, four locators 30 are used (only two shown). The locators 30 are generally cylindrical in shape. The locators 30 engage the seal unit 12 for a function to be described.

The hydroform die tube holding assembly 10 includes a seal unit elevator 32 supported on the lower die half 22. The seal unit 14 is connected to the seal unit elevator 32 by a suitable mechanism such as fasteners (not shown). The hydroform die tube holding assembly 10 also includes at least one, preferably a plurality of gas springs 34 extending upwardly from the seal unit elevator 32. Preferably, four gas springs 34 are used (only one shown). The gas springs 34 are of a nitrogen gas type. Each of the gas springs 34 includes a cylinder 36, a piston (not shown) disposed within the cylinder 36, and a piston rod 38 connected to the piston and extending axially from one end of the cylinder 36. The cylinders 36 are connected to the seal unit elevator 32 by a suitable mechanism such as fasteners (not shown). It should be appreciated that the cylinders 36 are connected to a source of gas (not shown) via a suitable mechanism such as hoses (not shown).

The hydroform die tube holding assembly 10 includes at least one, preferably a plurality of locators 40 extending upwardly from the lower die half 22 and into the seal unit elevator 32. Preferably, four locators 40 are used (only two shown). The locators 40 are generally cylindrical in shape. The locators 40 engage the seal unit elevator 32 for a function to be described.

Figure 3:
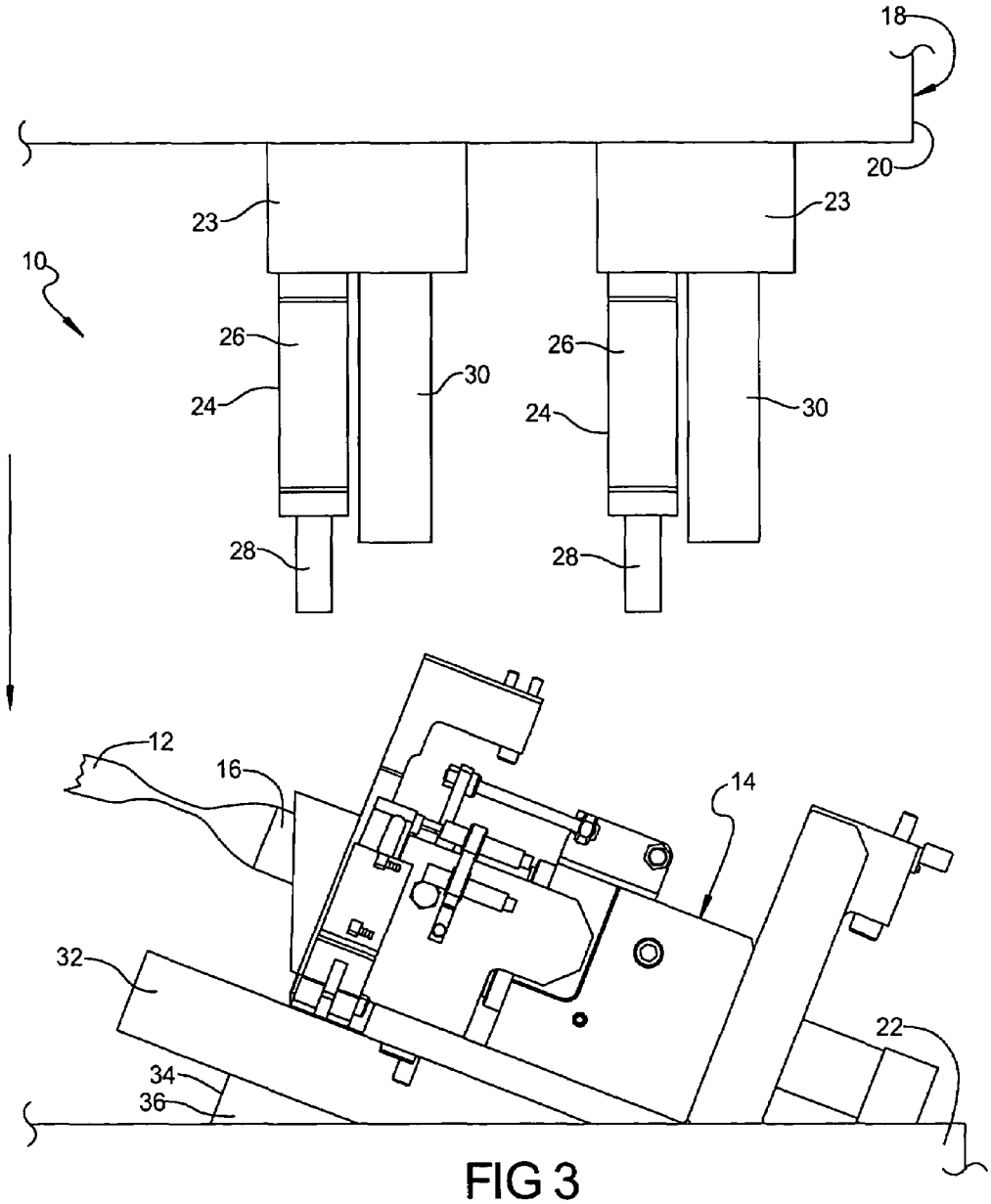
FIG. 3 is a view similar to FIG. 1 illustrating a first step of operation of the hydroform die tube holding assembly of FIGS. 1 and 2.

Referring to FIGS. 3 through 5, one embodiment of a method, according to the present invention, of operating the hydroform die tube holding assembly 10 is shown for hydroforming the tube 12 for assembly in automotive structures (not shown) of a vehicle (not shown). The method provides the ability to lock the tube 12 into its proper position and let the tube forming occur without allowing movement within the seal unit 14. The method is used to add travel to the seal unit 14 such that the seal unit 14 is driven down square ahead of the finished part form for the tube 12.

The method includes the step of providing a tubular member or tube 12. The tube 12 is made of a metal material. In one embodiment, the tube 12 has a generally circular cross-sectional shape and extends axially.

The method includes the step of hydroforming the tube 12. The tube 12 is placed in a die set, generally indicated at 18, comprised of an upper die half 20 and a lower die half 22. The upper die half 20 includes a cavity portion (not shown) and the lower die half 22 includes a cavity portion (not shown) for receiving the tube 12.

The ends of the tube 12 are placed over the protrusions 16 of the seal units 14 and sealed. Hydraulic fluid is pumped into the tube 12 under pressure. The upper die half 20 and lower die half 22 are progressively closed so that the tube 12 is progressively deformed and the pressurized fluid captured therein expands the walls of the tube 12 into the cavity portions of the die set 18.

In operation of the hydroform die tube holding assembly 10, as the upper die half 20 moves toward the lower die half 22, the gas springs 24 engage the seal unit elevator 32 to drive the seal unit elevator 32 downward ahead of the upper die half 20 engaging the lower die half 22 as illustrated in FIG. 4. The locators 30 engage the seal unit elevator 32 and drive the seal unit elevator 32 downward. The upper die half 20 continues to move toward the lower die half 22 until the upper die half 20 engages the lower die half 22 as illustrated in FIG. 5. When this occurs, the gas springs 24 take up or dwell, keeping pressure on the seal unit elevator 32. It should be appreciated that the locators 30 allows for driving the seal elevator unit 32 square. It should be appreciated that an upper jaw (not shown) of the upper die half 20 grabs the tube 12 at the same time the seal unit elevator 32 is going down.

The die halves are fully closed upon one another with the tube 12 being tightly clamped between the die halves. During this closing of the die halves, a relatively constant hydraulic pressure may be maintained within the tube 12 by incorporating a pressure relief valve (not shown) into the seal unit 14 enclosing the ends thereof so that hydraulic fluid may be forced from the tube 12 as it collapses.

Once the die is closed, the tube 12 is then expanded to a final cross-sectional profile by increasing the hydraulic pressure sufficient to exceed the yield limit of the tube 12 so that the tube 12 is forced into conformity with the tubular forming cavity portions of the die halves 20 and 22. The die halves 20 and 22 are then opened to permit removal of the finished tubular member from the die halves 20 and 22. When the die halves 20 and 22 are open, the gas springs 34 drive the seal unit elevator 32 upwardly. It should be appreciated that the locators 40 allow for driving the seal elevator unit 32 square.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A hydroform die tube holding assembly comprising:

at least one seal unit for sealing an end of a tube;

a seal unit elevator for attachment to a lower die half to operatively support said at least one seal unit; and at least one upper gas spring for attachment to an upper die half to engage said seal unit elevator to drive said seal unit elevator downward prior to the upper die half engaging the tube wherein said at least one upper as spring dwells when the upper die half engages a lower die half, keeping pressure on said seal unit elevator.

2. A hydroform die tube holding assembly as set forth in claim 1 including at least one upper locator for attachment to the upper die half to drive said seal unit elevator squarely relative to the lower die half.

3. A hydroform die tube holding assembly as set forth in claim 1 including a lower gas spring for attachment to the lower die half to engage said seal unit elevator to drive said seal unit elevator upward when the upper die half opens relative to the lower die half.

4. A hydroform die tube holding assembly as set forth in claim 1 including at least one lower locator for attachment to the lower die half to drive said seal unit elevator squarely relative to the upper die half.

5. A hydroform die tube holding assembly as set forth in claim 1 wherein said at least one upper locator is of a cylindrical shape.

6. A hydroform die tube holding assembly as set forth in claim 1 wherein said at least one lower locator is of a cylindrical shape.

7. A hydroform die tube holding assembly as set forth in claim 1 including at least one mounting block for connection to the upper die half, said at least one upper gas spring extending downwardly from said at least one mounting block.

8. A hydroform die tube holding assembly as set forth in claim 1 wherein said at least one upper gas spring is of a nitrogen gas type.

9. A hydroform die tube holding assembly as set forth in claim 1 wherein said at least one lower gas spring is of a nitrogen gas type.

10. A method of hydroforming a tube using a hydroform die tube holding assembly, said method comprising the steps of:

providing a seal unit for sealing an end of a tube;

supporting the seal unit with a seal unit elevator on a lower die half;

providing at least one upper gas spring for attachment to an upper die half;

engaging the seal unit elevator with the at least one upper gas spring; and driving the seal unit elevator downward prior to the upper die half engaging the tube;

closing the upper die half and lower die half together;

engaging the upper die half with the lower die half, dwelling the at least one upper gas spring, and keeping pressure on the seal unit elevator; and hydroforming the tube to form a hydroformed tubular member.

11. A method as set forth in claim 10 wherein said step of providing at least one upper locator for attachment to the upper die half.

12. A method as set forth in claim 11 including the step of driving the seal unit elevator squarely relative to the lower die half with the at least one upper locator.

13. A method as set forth in claim 10 including the step of providing a lower gas spring for attachment to the lower die half to engage the seal unit elevator.

14. A method as set forth in claim 13 including the step of opening the upper die half and lower die half to remove the hydroformed tubular member.

15. A method as set forth in claim 14 including the step of driving the seal unit elevator upward with the lower gas spring when the upper die half opens relative to the lower die half.

16. A method as set forth in claim 12 including the step of driving the seal unit elevator squarely relative to the upper die half with the at least one lower locator.

17. A method as set forth in claim 16 including the step of providing at least one lower locator for attachment to the lower die half.

18. A method as set forth in claim 12 including the step of providing at least one mounting block for connection to the upper die half and mounting the at least one upper gas spring to the at least one mount block to extend downwardly from the at least one mounting block.

19. A method of hydroforming a tube using a hydroform die tube holding assembly, said method comprising the steps of:

providing a seal unit for sealing an end of a tube;

providing a hydroform die tube holding assembly comprising at least one seal unit for sealing an end of a tube, a seal unit elevator for attachment to a lower die half to operatively support said at least one seal unit, and at least one upper gas spring for attachment to an upper die half to engage the seal unit elevator;

engaging the seal unit elevator with the at least one upper gas spring;

driving the seal unit elevator downward prior to the upper die half engaging the tube;

closing the upper die half and lower die half together;

engaging the upper die half with the lower die half, dwelling the at least one upper gas spring and keeping pressure on the seal unit elevator;

hydroforming the tube to form a hydroformed tubular member; and opening the upper die half and lower die half to remove the hydroformed tubular member.

* * * * *